US005133700A

United States Patent [19]

Braathen

[11] Patent Number: 5,133,700

[45] Date of Patent: Jul. 28, 1992

[54] ARRANGEMENT IN A FLEXIBLE SLIDING MAT, IF DESIRED FOR USE WITH AN EXERCISER

[76] Inventor: Thor F. Braathen, N-3358 N., Eggedal, Norway

[21] Appl. No.: 623,423

[22] PCT Filed: Jun. 7, 1989

[86] PCT No.: PCT/NO89/00056

§ 371 Date: Nov. 29, 1990

§ 102(e) Date: Nov. 29, 1990

[87] PCT Pub. No.: WO89/11893

PCT Pub. Date: Dec. 14, 1989

[30] Foreign Application Priority Data

Jun. 8, 1988 [NO] Norway ..... 882523

[51] Int. Cl.[5] ..... A63B 22/00

[52] U.S. Cl. ..... 482/51; 482/13; 472/118

[58] Field of Search ..... 272/70, 97, 93, 56.5 R, 272/56.5 SS; 434/255

[56] References Cited

U.S. PATENT DOCUMENTS 821,881 5/1906 Pell et al. ..... 273/286

4,779,862 10/1988 Keppler ..... 272/70

FOREIGN PATENT DOCUMENTS 2041227 9/1980 United Kingdom ..... 272/56.5 R

*Primary Examiner*—Richard J. Apley

*Assistant Examiner*—D. F. Crosby

*Attorney, Agent, or Firm*—Wenderoth, Lind & Ponack

[57] ABSTRACT

A flexible sliding mat may be provided on a floor and used with an exerciser to simulate skating, snow skiing, etc. A user's feet slide from one end to the other end of a sliding surface member of the sliding mat and bear against transverse stop/kick-off edge elements at oppostie ends of the sliding surface member. The stop/kick-off edge elements are displaceable along sliding mat for adjustment of the length of the sliding surface member. Each edge element includes a pair of members including an upper member placed above the sliding mat and a lower member placed below the sliding mat. Each lower member has a flange which extends beyond the longitudinal side of the respective upper member. The upper and lower members are connected by screw bolts and nuts extending through aligned holes at each end of each pair of members. By loosening the nuts, the pair of members can be displaced along the sliding mat for adjustment to a desired length between the stop/kick-off edge elements for various exercises, and dependent on the size of the user. The sliding mat preferably has a lower surface providing good friction against the support, e.g. made of a rubber material.

14 Claims, 2 Drawing Sheets

ARRANGEMENT IN A FLEXIBLE SLIDING MAT, IF DESIRED FOR USE WITH AN EXERCISER

BACKGROUND OF THE INVENTION

The present invention relates to an arrangement of a flexible sliding mat to be placed on a floor and, if desired, for use with an exerciser, to simulate skating, snow skiing, etc.

A known and used sliding mat includes a piece of linoleum with a friction coating glued to the underside to make the mat lie firmly on a floor, and provided with transverse stop/kick-off edge elements in the shape of, e.g. cover strips glued onto the mat. Such a sliding mat may be rolled up to a minimum size bulk for storage or transportation, but has the disadvantage that the sliding mat, when rolled out, will be bumpy after having been rolled up.

SUMMARY OF THE INVENTION

It is an object of the present invention to provide a sliding mat which has considerably improved properties in use as compared with the known sliding mat, both with regard to its capability of lying firmly in a flat state on its support when rolled out, and to the possibility of adjusting the distance between stop/kick-off edge elements in the form of transverse strips. Also, it is an object to eliminate a disadvantage of the present strip-shaped stop/kick-off edge elements, i.e. a tendency to tilt or twist outwardly when a user's foot hits the stop edge during sliding movement, thus resulting in the foot sliding across the stop edge element.

BRIEF DESCRIPTION OF THE DRAWINGS

An embodiment of the invention will be described in more detail below, with reference to the accompanying drawings, wherein.

DETAILED DESCRIPTION OF THE INVENTION

Figure 1:
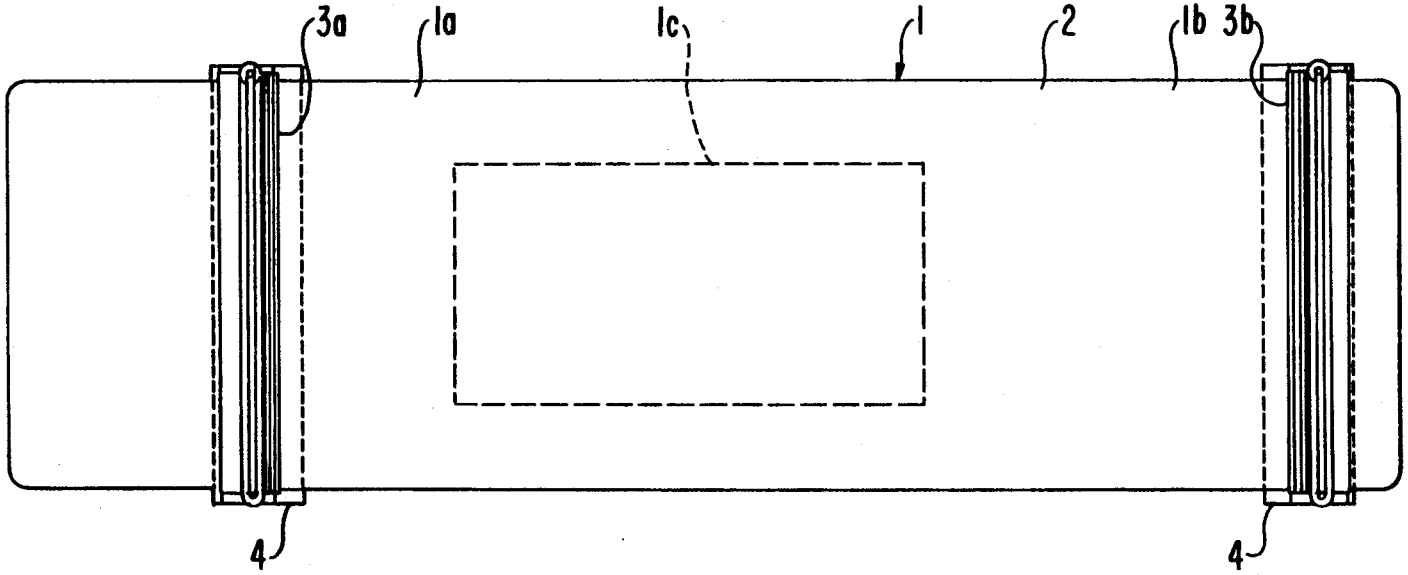
FIG. 1 is a plan view from above of a sliding mat.
Figure 2:
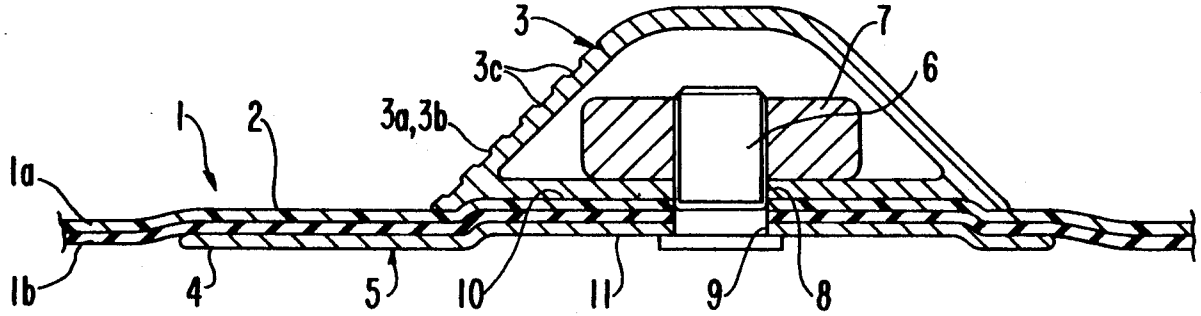
FIG. 2 is a side elevation and partly in section of a detail of such mat, and shown on an enlarged scale.

A sliding mat 1, as shown in FIGS. 1 and 2, comprises a sliding surface member 2 and transverse stop/kick-off edge elements 3*a*, 3*b* at opposite ends 1*a*, 1*b* of sliding surface member 2. At least one of stop/kick-off edge elements 3*a*, 3*b* is displaceable along the sliding mat 1 for adjustment of the length/extension of sliding surface member 2 to be adapted to the exercise of interest and the size of the user.

Each stop/kick-off edge element 3*a*, 3*b* has a longitudinal flange 4, with flanges 4 facing each other, i.e. inwards of sliding surface member 2. Flanges 4 are provided below sliding mat 1 to prevent the stop/kick-off edge elements 3*a*, 3*b* from tilting when the user's foot or feet hit them laterally, since at the same time the foot exerts a vertical load on flange 4.

Each stop/kick-off edge element 3*a*, 3*b*, which preferably are identical, consists of two longitudinal aluminum members 3, 5, although the members may obviously be manufactured from any suitable material. Member 3 which forms the stop/kick-off edge element 3*a*, 3*b* proper, bears against the upper side of the sliding mat, i.e. sliding surface member 2, whereas the other member 5 is substantially flat and bears against the lower side of sliding mat 1, directly below upper member 3. Upper and lower members 3, 5 are connected at each of opposite ends thereof by releasable connecting members. The connecting members are secured to sliding mat 1. Lower member 5 includes the flange 4 extending outwardly beyond one longitudinal side of upper member 3.

The releasable connecting members each include a screw bolt 6 and a nut 7 for cooperation with aligned holes 8, 9 in the end portions of upper and lower members 3, 5. The under side and the upper side of upper and lower members 3, 5, respectively, having complementary cross sectional shapes 10, 11, e.g. a concave cross sectional shape 10 and a convex cross sectional shape 11. The sliding mat can be clamped firmly between members 3, 5 so that the latter will not slide due to lateral loads when the user does exercises on the sliding mat. As shown in FIG. 2, upper member 3 may be hollow with at least one oblique face forming an obtuse angle with sliding surface member 2 to form stop/kick-off edge member 3*a*, 3*b*.

Sliding mat 1 advantageously may include a preferably transparent plastic mat 1*a* forming sliding surface member 2 and an underlying rubber mat 1*b* to achieve non-slip contact on the underlying floor. A legend, a drawing, etc., e.g. an illustration 1*c* showing various exercises that may be carried out with sliding mat 1, if desired in combination with an exerciser, may be provided between the transparent plastic mat 1*a*, and rubber mat 1*b*.

Figure 3:
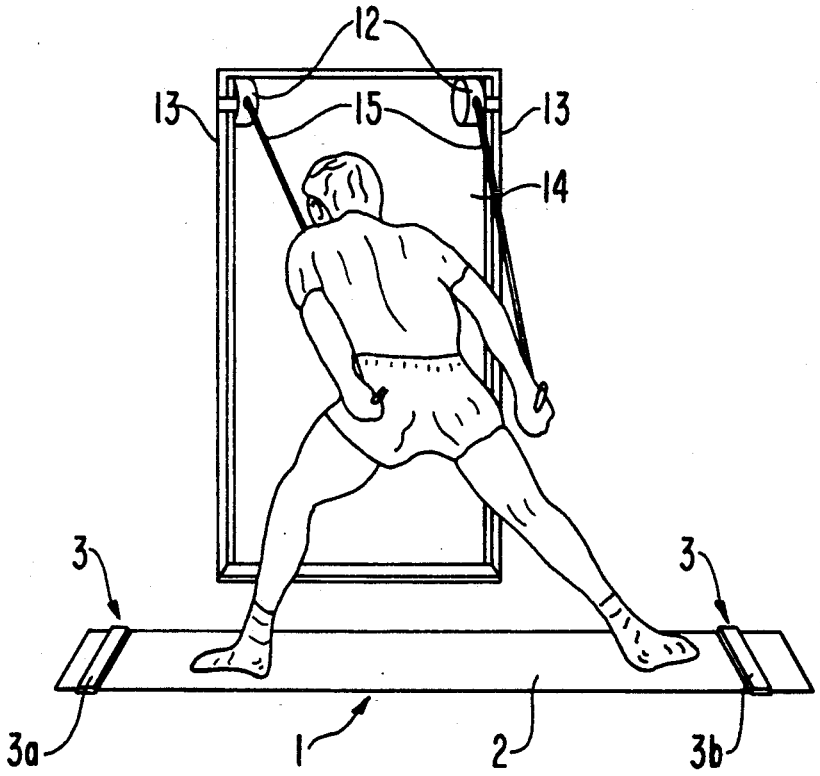
FIG. 3 is a perspective view of the sliding mat in use with an exerciser.

A combination of sliding mat 1 and an exerciser is shown in perspective in FIG. 3. The exerciser in this case comprises two resistance reels 12 which are attached to a door frame 13 adjacent the top of a door opening 14. Resistance reels 12 furthermore comprise extractive ropes 15 which may, e.g. be pulled out against an adjustable frictional resistance. By arranging sliding mat 1 in front of door opening 14, the user can practice skating or skiing, as shown in FIG. 3.

The inner lateral edge of upper member 3 may have longitudinal grooves 3*c* for preventing a foot of a user from sliding outwardly after hitting the stop edge element 3*a*, 3*b*. One pair of members 3, 5 is suitably provided at one end of sliding mat 1, whereas the second pair of members 3, 5 is displaceable in opposite directions at the other end portion of sliding mat 1, thus to be adjusted to the correct distance between stop/kick-off edge elements 3*a*, 3*b*. When members 3, 5 have been adjusted, nuts 7 are tightened on screw bolts 6. Members 3, 5 are thus urged towards each other and will simultaneously firmly clamp sliding mat 1 therebetween.

I claim:

1. A flexible sliding mat to be placed on a floor for use in exercising, said mat comprising:

a sliding surface member having an upper surface over which the feet of a user may slide during exercise and opposite end portions, said sliding surface member having a flexibility sufficient to enable said sliding surface member to be rolled up when not in use;

a pair of stop/kick-off edge elements connected to and extending across respective said opposite end portions and defining stops against which abut the feet of the user, at least one said edge element being displaceable in opposite directions relative to said sliding surface member; and each said edge element including a longitudinal flange positioned beneath said sliding surface member, said flanges of said pair of edge elements extending toward and being spaced from each other by amounts sufficient to ensure that, when a foot of the user abuts either of said edge elements, the user's foot will exert a downward force on the respective said flange preventing said edge element from tilting.

2. A mat as claimed in claim 1, wherein each said edge element comprises an upper member positioned above and bearing against said sliding surface member, a lower member positioned beneath said sliding surface member, and releasable connecting means for releasably clamping said sliding surface member between said upper and lower members.

3. A mat as claimed in claim 2, wherein said releasable connecting means is provide at each of opposite ends of said upper and lower members.

4. A mat as claimed in claim 2, wherein said lower member includes said flange.

5. A mat as claimed in claim 4, wherein said flange extends beyond said upper member in a direction toward the other said edge element.

6. A mat as claimed in claim 2, wherein a lower surface of said upper member and an upper surface of said lower member have complementary cross-sectional shapes to enable interlock therebetween and clamping therebetween of said sliding surface member.

7. A mat as claimed in claim 6, wherein said lower surface of said upper member has a concave configuration and said upper surface of said lower member has a convex configuration.

8. A mat as claimed in claim 2, wherein said connecting means comprises a bolt extending through aligned holes in said upper and lower members, and a nut threaded on said bolt.

9. A mat as claimed in claim 2, wherein said upper member is hollow.

10. A mat as claimed in claim 2, wherein said upper member has a lateral surface extending at an obtuse angle to said sliding surface member and defining the respective said stop.

11. A mat as claimed in claim 1, wherein said sliding surface member comprises a transparent plastic mat.

12. A mat as claimed in claim 11, further comprising an underlying mat formed of a high friction material and positioned beneath said plastic mat.

13. A mat as claimed in claim 12, wherein said underlying mat is formed of rubber.

14. A mat as claimed in claim 12, further comprising instructional indicia positioned between said underlying mat and said plastic mat and visible to a user through said plastic mat.

* * * * *